United States Patent [19]

Arikawa

[11] 4,326,185

[45] Apr. 20, 1982

[54] ELECTRICAL FUSE WITH SEMI-CYLINDRICAL CASINGS

[75] Inventor: Hiroo Arikawa, Tokyo, Japan

[73] Assignee: San-O Industrial Company, Ltd., Tokyo, Japan

[21] Appl. No.: 257,923

[22] Filed: Apr. 27, 1981

[51] Int. Cl.[3] ..... H01H 85/02

[52] U.S. Cl. ..... 337/201; 337/231; 337/246

[58] Field of Search ..... 337/186, 190, 201, 228, 337/231, 234, 246, 248

[56] References Cited

U.S. PATENT DOCUMENTS

| | | | |
|---|---|---|---|
| 1,046,705 | 12/1912 | Young | 337/246 |
| 1,087,417 | 2/1914 | Young | 337/246 |
| 2,189,101 | 2/1940 | Carter | 337/246 |

*Primary Examiner*—George Harris

[57] ABSTRACT

An electric fuse having a cartridge formed of a pair of semi-cylindrical casings, i.e., a body casing and a cover casing. The cover casing has a circumferential flat edge surface and a central ridge protruding above the flat surface, and the body casing has a circumferential flat edge surface and a central channel recessed therein for receiving the ridge section of the cover casing so as to form a passageway between the ridge section of the cover casing and the channel when the two casings are coupled to form the fuse cartridge. A fusible element is stretched diagonally between the ends of the body casing, passing through a pair of grooves in the edge surfaces at the end of the body casing, extending through the passageway and out through a pair of grooves disposed at the ends of the body casing, approximately in the middle thereof. The ends of the fusible element are soldered and capped or they may be soldered to the respective ends of a lead wire without end caps.

8 Claims, 8 Drawing Figures

ELECTRICAL FUSE WITH SEMI-CYLINDRICAL CASINGS

FIELD OF INVENTION

The present invention relates to fuses and is particularly related to a fuse of novel construction comprising a pair of semi-cylindrical casings which are united together to form the fuse cartridge.

This invention is also concerned with a method of manufacturing the novel fuse which is described herein.

BACKGROUND OF INVENTION

The conventional method of manufacturing fuses (except for the so-called renewable fuses or dual element fuses) involves a rather cumbersome procedure. According to the conventional method, a long tube made of glass or some other insulating material is cut to the size of the desired fuse and two metal caps or ferrules are then used to cap the ends of the glass tube to form the fuse cartridge. A fusible element is then passed through a perforation in the end caps and the ends of the fusible element are then soldered to the end caps to establish electrical contact with the electrical circuit in which the fuse is used.

When it is desired to attach a lead wire to the end caps, the respective ends of the fusible elements and the lead wire are soldered together simultaneously.

Since the various steps of the manufacture of the fuse are performed manually, workmanship, quality and productivity of fuses made by such conventional techniques depend largely on the skill of the worker. Slackened stretching of the fusible element, inadequate soldering, insufficient juncture between the ends of lead wire and the end caps, or with the fusible element, quantitative soldering and setting of the lead wire in a definite direction, are few of the problems and difficulties which are associated with the conventional method.

Since the advent of the so-called electronic age, there has been increasing demands for miniature electric fuses which employ extremely fine fusible elements. The aforementioned difficulties of manufacture, handling and soldering of the fusible element present even more serious problems and difficulties in the manufacture of miniature fuses.

Accordingly, it is an object of this invention to provide an improved method of manufacturing fuses whereby the problems and difficulties inherent in the conventional methods are substantially reduced or eliminated.

It is also an object of the present invention to provide a fuse of novel construction which, due to the unique structure and configuration of its component parts, can be assembled more efficiently.

The foregoing and other objects of this invention will be more clearly comprehended from the following detailed description of a preferred embodiment of the invention and the accompanying drawings.

BRIEF DESCRIPTION OF DRAWINGS

In the drawings, wherein like reference numerals and characters are employed to designate like parts.

SUMMARY OF INVENTION

In accordance with this invention two semi-cylindrical members (casings) of novel construction are used to form the fuse cartridge. These casings consist of a body casing and a cover casing adapted to be coupled to the body casing.

The cover casing has a circumferential flat edge surface having a ridge section spanning substantially the length thereof, and the body casing has a circumferential flat edge surface having a channel recessed therein and extending substantially the length thereof. The height of the ridge section is slightly less than the depth of the channel so that a passageway is formed between the ridge and the channel when the two casings are coupled to form the fuse cartridge.

A fusible element is passed through a groove cut in the edge surface at the end of the body casing, extending through the passageway and out from another groove formed in the middle of the end of the body casing. The fusible element is stretched diagonally in the body casing and passes through a groove disposed diagonally at the other end of this casing, extends through the passageway and through a similarly formed groove at this other end of the casing.

Each end of the fusible element is soldered at the respective ends of the body casing and capped by ferrules or some other metallic end caps.

Alternatively, when a lead wire is to be used, one end of the lead wire is attached to the end of the fusible element and the other end of the lead wire is passed through the groove disposed in the middle of the end of the body casing.

DETAILED DESCRIPTION OF PREFERRED EMBODIMENT OF INVENTION

Figure 1:
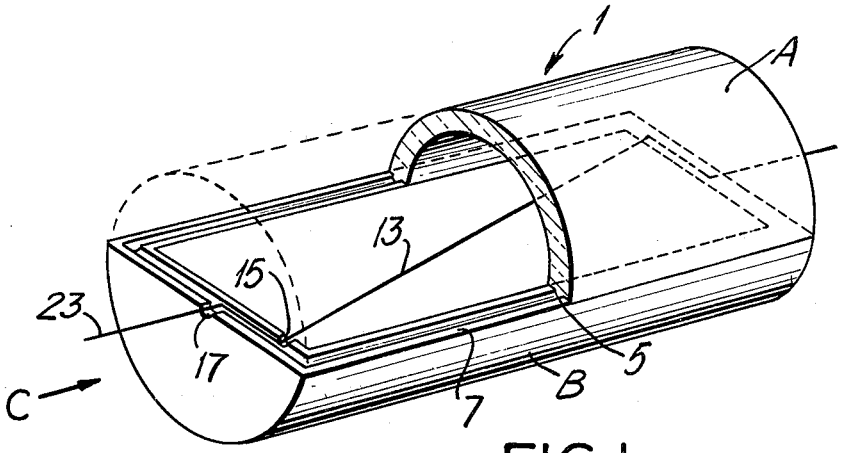
FIG. 1 is a perspective, partially cutaway, view of a fuse made in accordance with this invention wherein two semi-cylindrical casings are mated to form the fuse cartridge.

Referring first to FIG. 1, there is shown a fuse having a fuse cartridge 1 formed of a pair of generally cylindrical casings A and B made of glass, plastic, ceramic (e.g., steatite) or some other insulating material. Casings A and B are of equal length and each includes an end section so that when the two casings are assembled together, they form and define the fuse cartridge.

The semi-cylindrical casing A has a circumferential flat edge surface 3 having a central ridge section 5 which protrude above the flat edge surface.

The other semi-cylindrical casing B also has a circumferential flat edge surface 7 having a central recess or channel 9 for receiving the edge surface 3.

Figure 2:
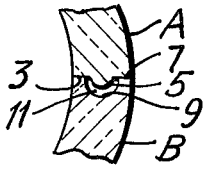
FIG. 2 is a sectional view illustrating the manner in which the two semi-cylindrical casings of the fuse cartridge are coupled together at their respective edges.

The channel 9 of casing B is recessed at a slightly greater degree than the protrusion of the ridge section 5 of casing A so that when the two casings are coupled together, a passageway 11 is formed therebetween (see FIG. 2) for the passage of a fusible element or a lead wire. Meanwhile, the respective flat edge surfaces of the two casings, i.e., edge surfaces 3 and 5 are engaged to form the fuse cartridge.

In order to impart additional structural integrity to the fuse cartridge, a suitable adhesive may be applied to the flat edge surfaces 3 and 7 prior to coupling of the casings A and B.

Thus, the novel provision of two semi-cylindrical casings having the unique structure and configuration herein described permits ready and efficient assembly of the fuse cartridge.

A fuse element 13 is inserted through a groove 15 cut in the edge surface 7 at the ends of casing B. The fusible element 13 passes through the groove 15 and passageway 11 and out through another groove 17 cut in the edge surface 7 of casing B.

Figure 4:
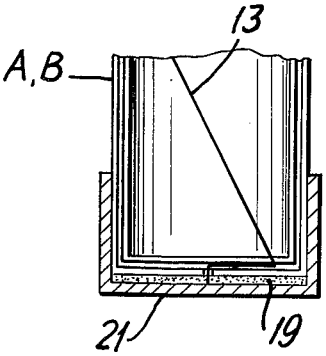
FIG. 4 is another sectional view showing how the ends of the fusible element are soldered to the respective end caps of the fuse in accordance with the embodiment shown in FIG. 5.

The end of the fusible element 13 coming out of the casing B is soldered as in 19 to end caps or ferrules 21 as shown in FIG. 4.

Figure 5:
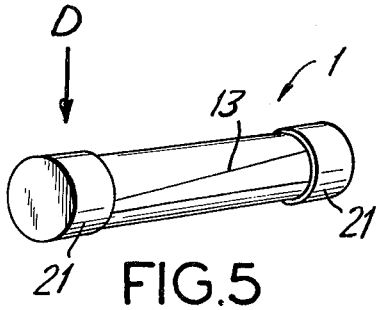
FIG. 5 is a perspective view of a fuse made in accordance with one embodiment of this invention, with end caps but without lead wire.

A perspective view of a fuse of the type hereinbefore described is shown in FIG. 5.

In another embodiment of the invention wherein the fuse is provided with a lead wire at each end, the end of the fusible element 13 which passes through the groove 15 in casing B is attached to one end of a lead wire 23 and these ends are soldered together as in 25. The other end of the lead wire is passed through the groove 15 as shown in FIG. 3.

Figure 3:
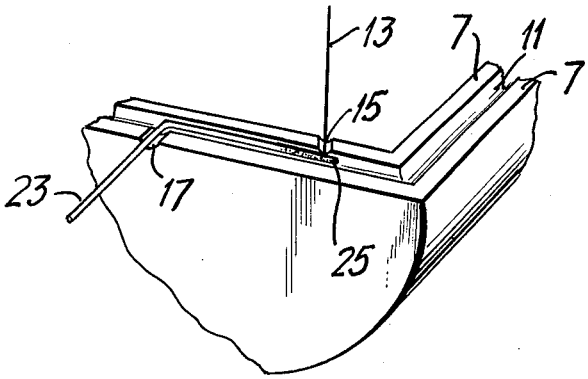
FIG. 3 is a sectional view, in exaggerated dimensions, illustrating the manner in which a lead wire may be soldered to the fusible element in accordance with one embodiment of the invention illutrated in FIG. 6.
Figure 6:
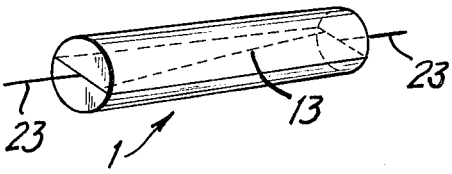
FIG. 6 is a perspective view similar to FIG. 5, but with lead wire and without end caps, according to a different embodiment of the invention.

In the embodiment shown in FIG. 3, no end caps are used. A perspective view of a fuse made according to this embodiment is shown in FIG. 6.

In practice, the fusible element 13 is stretched diagonally between the ends of the casing B before the two casings are coupled as aforesaid. This simplifies the manufacturing procedure of the fuse and eliminates the aforementioned problems of the conventional method of fuse manufacture.

Thus, in the present fuse structure, the semi-cylindrical casing B constitutes, in essence, the body of the fuse while the semi-cylindrical casing A is the cover for body casing B.

In practice, the fusible element is stretched and secured in body casing B before body casing A is coupled thereto to form the fuse cartridge.

Thus, it will be appreciated that this invention provides a unique and efficient method for making the novel fuse described herein.

While the present invention has been described in some detail, and with certain degree of particularity, it is understood that numerous modifications may be made which nevertheless fall within the scope and contemplation of the invention.

What is claimed is:

1. An electric fuse made of a pair of generally semicylindrical casings coupled to form the fuse cartridge; a body casing and a cover casing for said body casing, said cover casing having a circumferential flat edge surface and a central ridge section protruding above said flat edge surface, spanning substantially the length thereof, said body casing having a circumferential flat edge surface and a central channel recessed therein and extending substantially the length of said flat edge surface of the body casing, said ridge section being adapted to be received by and engaged into said channel so as to form a passageway between said ridge section and said channel and causing said flat edge surfaces to be brought into mating relationship when said body casing and said cover casing are coupled to form the fuse cartridge; a fusible element stretched diagonally between the ends of said body casing, the ends of said fusible element passing through a pair of diagonally disposed grooves in the edge surface of said body casing at each end thereof and into said passageway between said ridge section and said channel, and out through a pair of grooves, each disposed at the end of said body casing at approximately the middle thereof and wherein the ends of said fusible element are soldered to the respective ends of the body casing.

2. A fuse as in claim 1 wherein the soldered ends of the fuse are capped by a metallic enclosure means.

3. A fuse as in claim 1 wherein each of said flat edge surfaces of the body casing and the cover casing has an adhesive coating to insure more rigid mating of said surfaces.

4. A fuse as in claim 2 wherein each of said flat edge surfaces of the body casing and the cover casing has an adhesive coating to insure more rigid mating of said surfaces.

5. An electric fuse made of a pair of generally semicylindrical casings coupled to form the fuse cartridge; a body casing and a cover casing for said body casing, said cover casing having a circumferential flat edge surface and a central ridge section protruding above said flat edge surface, spanning substantially the length thereof, said body casing having a circumferential flat edge surface and a central channel recessed therein and extending substantially the length of said flat edge surface of the body casing, said ridge section being adapted to be received by and engaged into said channel so as to form a passageway between said ridge section and said channel and causing said flat edge surfaces to be brought into mating relationship when said body casing and said cover casing are coupled to form the fuse cartridge; a fusible element stretched diagonally between the ends of said body casing, the ends of said fusible element passing through a pair of diagonally disposed grooves in the edge surface of said body casing at each end thereof and into said passageway beween said ridge section and said channel, a lead wire having one end attached to the end of the fusible element and having its other end extending through said passageway and out from said body casing through a groove approximately midway in said body casing.

6. A fuse as in claim 5 wherein the end of said lead wire is attached to the end of said fusible element by solder.

7. A fuse as in claim 5 wherein each of said flat edge surfaces of the body casing and the cover casing has an adhesive coating to insure more rigid mating of said surfaces.

8. A fuse as in claim 6 wherein each of said flat edge surfaces of the body casing and the cover casing has an adhesive coating to insure more rigid mating of said surfaces.

* * * * *